United States Patent [19]

Janszen

[11] 4,346,637

[45] Aug. 31, 1982

[54] SPIN-JANGLE TAMBOURINE

[76] Inventor: Bryan L. Janszen, 60 Candlewood Dr., Yonkers, N.Y. 10710

[21] Appl. No.: 214,209

[22] Filed: Dec. 8, 1980

[51] Int. Cl.[3] ..... G10D 13/02

[52] U.S. Cl. ..... 84/418

[58] Field of Search ..... 84/402, 418, 422 S

[56] References Cited

U.S. PATENT DOCUMENTS 1,333,565 3/1920 Newlin ..... 84/418 X 3,675,528 7/1972 Brick ..... 84/418

4,150,602 4/1979 Santiago ..... 84/402

4,226,163 10/1980 Welcomer ..... 84/422 S

*Primary Examiner*—Lawrence R. Franklin

*Attorney, Agent, or Firm*—Karl F. Milde, Jr.

[57] ABSTRACT

A tambourine is disclosed having a mechanism mounted therein to operate individual actuators arranged to move the cymbals or "jingles" of the tambourine causing them to contact one another and produce sound. The mechanism may include a member integral with the tambourine frame for spinning the tambourine on its latitudinal axis.

26 Claims, 28 Drawing Figures

SPIN-JANGLE TAMBOURINE

BACKGROUND OF THE INVENTION

The present disclosure relates to a tambourine in which an activator mechanism is used to move the cymbals or "jingles" of a tambourine and thereby generate sound. A spinning tambourine is disclosed in the U.S. Pat. No. 3,675,528 to Brick. The Brick tambourine comprises a frame having a handle integrally formed as part of the frame. The cymbals or "jingles" of the tambourine are positioned on the frame in windows in a conventional manner and extend away from the handle portion of the frame. The handle also has an aperture therein which contains a sleeve that rotates in bearings mounted within the handle. The cymbals or jingles of the Brick tambourine are activated only by a shaking motion applied in the conventional manner. The cymbals are deactivated i.e. not able to produce sound, due to centrifugal force when the tambourine is spun. Centrifugal force holds the pairs of cymbals against the frame an in contact with one another thereby preventing them from producing sound. A mechanism is not provided for striking or moving the cymbals directly by hammers or equivalent means.

The prior art United States patents also teach other tambourines and comprise the United States patents to Blumenfeld, U.S. Pat. No. 3,481,239; Bills, U.S. Pat. No. 3,994,197; Thifault, U.S. Pat. No. 3,076,372; and Santiago, Senior, U.S. Pat. No. 4,150,602.

None of these prior art references disclose a mechanism for individually striking the cymbals or "jingles" of a tambourine or moving them to contact one another to produce sound.

Accordingly, it is an object of the present invention to provide such a mechanism.

It is a further object of the present invention to provide a novel mechanism within a tambourine which is employed to move or strike the individual cymbals or any combination thereof in the tambourine by spinning or rotating the mechanism or spinning or rotating the tambourine which in turn activates the mechanism.

These and other objects have been achieved according to the present invention and will be understood more completely by reference to the appended claims, the drawings and the following disclosure.

SUMMARY OF THE INVENTION

The present invention relates to an improvement in a tambourine disposed to be grasped by an entertainer and manipulated or operated to generate sound from the cymbals therein, comprising a frame having window members therein for receiving and having cymbal members rotatably mounted therein. The cymbals are adapted to generate sound, and are used in combination with activator members mounted on the frame operatively engaging the cymbals for moving the cymbals and to cause the cymbals to generate sound by contacting one another. A spinning member is mounted in the frame for rotating the activator. The activator member is operatively associated with the spinning member to cause the activator member to engage the cymbals. In one embodiment, the cymbals may comprise at least two cymbals in each of the windows.

The activator member may comprise a flexible shaft member which can be rotated about its longitudinal axis when in a flexed configuration, the flexible shaft being mounted on the frame and extending from the spinning member to the window. Striking members are mounted on the shaft for striking the cymbals when the shaft is rotated on its longitudinal axis, the spinning member operatively engaging the shaft for rotating the shaft on its longitudinal axis.

The window may comprise a plurality of windows, each of the windows having cymbals mounted therein, the cymbals being mounted on pin members passing through the windows and secured to the frame for receiving the cymbals in the frame. The cymbals have an opening therein for receiving a pin, the opening being wider than the diameter of the pin.

In this embodiment, the striking member may comprises a plurality of such members, at least one of them being positioned to strike one of the cymbals next adjacent the opening in one of the cymbals, the others being positioned to strike the other cymbals at the edges thereof. When employing this embodiment, the striking member next adjacent the opening prevents the flexible shaft from making a full revolution until sufficient torque is applied to the shaft and is stored in the shaft as potential energy which is released as kinetic energy once the striking member next adjacent the opening has sufficient torque applied to it through the shaft to rotate. As a result, the other of the striking members which are positioned to strike the edge of the cymbal members are in a stopped position during the application of torque to the shaft and are suddenly rotated when sufficient torque is applied to the shaft to rotate the striking member next adjacent the opening. This produces a rhythmic or intermittent sound when the striking members at the edges of the cymbals strike the cymbals even though the torque applied to the flexible shaft is continuously applied.

The spinning member may comprise an open-ended tube rotatably mounted on the frame, the longitudinal axis of the tube being substantially coincidental with the lateral axis of the frame. The flexible shaft is rotatably connected to the tube in this embodiment by a driving member on the tube for applying a rotating motion to the shaft. A driven member is provided on the flexible shaft for transmitting a rotating motion to the shaft.

The driving member may comprise a driving gear member extending around the tube and the driven member may comprise a driven gear member mounted to and extending around the longitiudinal axis of the flexible shaft.

In another embodiment the driving gear member may comprise a double faced ring gear or two ring gears, which are diametrically opposed to one another. The flexible shaft extends around the frame from one face of the ring gear to the other face of the ring gear. The driven gear members comprises a first gear mounted to and extending around the longitudinal axis of the flexble shaft at one end thereof and it engages one face of the ring gear and a second gear mounted to and extending around the longitudinal axis of the flexible shaft at the other end thereof for engaging the other face of the ring gear.

Any friction developed in the bearings in which the shaft is mounted is more readily overcome by driving the shaft at both ends as set forth herein. This enables the shaft to be driven more positively and to overcome forces that interfere with its even rotation.

The tube member may be rotatably mounted in a dome secured to the frame. In another embodiment, the dome may have an opening in the top thereof to allow passage of a finger through the dome.

In a further embodiment, the tube is of a tapered configuration so that it may be readily adapted to receive a finger of any size when the tambourine is spun by a placement on a finger. In another embodiment, the tube may be constructed of a soft pliable member or lined with a soft pliable member in order to provide a degree of comfort for the entertainer operating the tambourine. The tube may also contain various nibs along the wall thereof to better grip the finger and also provide for the circulation of air between the finger and the inner wall of the tube for additional comfort.

In a further embodiment a drive belt member is provided operatively connecting the driving member and the driven member. When the driving member comprises a gear and the driven member comprises a gear in this embodiment, the drive belt will comprise a drive belt or a drive chain such as a flexible microchain for the engagement of the gear teeth.

Where there are two driven gears, each on the ends of the flexible shaft, the drive belt will be looped.

Where the cymbals are mounted on pins as previously described herein, the activator members may comprise members for rotating the pins and rotating members extending from the pins for rotating the cymbals when the pins are rotated on their longitudinal axis. The spinning member operatively engages the activator member for rotating the pins on their longitudinal axis.

Where the spinning member comprises the open ended tube as previously described, the pins are operatively connected to the tube by driving members on the tube for transmitting a rotating motion to the pins and driven members on the pins for receiving a rotating motion.

In the previous embodiment, the driving members may comprise driving wheel members and the driven members may comprise driven wheel members operatively connected to one another through a drive belt member.

When the driving wheel comprises a gear and the driven wheel comprises a gear, the drive belt will comprise a chain drive.

In a further embodiment the cymbals may comprise at least two opposed cymbals in each of the windows and furthermore such cymbals may have dimpels on their surfaces, the dimpels on opposed cymbals being extended towards one another.

The striking member may also comprise a rotating member mounted in the frame for rotating on its lateral axis within the frame, the lateral axis of the rotating member being substantially coincidental with the lateral axis of the frame and the longitudinal axis of the spinning member. The rotating member extends to and slightly beyond the periphery of the cymbals for striking the cymbals when rotated. In another embodiment, the spinning member may comprise the open ended tube as previously noted herein.

The rotating member may substantially comprise either a disc by which it is meant a flat member as used in the ordinary sense of the term flat, or a second frame or a substantially three-dimensional member such as a sphere, cube or solid triangle such as a pyramid having hammers extending from the surface thereof for striking the cymbals, said hammers being in alignment with the cymbals so that the cymbals are readily stricken at the edges thereof.

In further embodiments a crank handle may be provided which extends from the spinning member. Additionally an electric motor may be provided which is operatively associated with the spinning member to rotate the spinning member. Furthermore, the tambourine may have lights and a power source operatively associated with the tambourine for illuminating the cymbals. The power source in this instance may comprise any known power source such as a battery or a dynamo driven through the spinning member.

BRIEF DESCRIPTION OF THE DRAWING

FIG. 1A is a side elevation of a fully extended flexible shaft having striking members on it according to one embodiment of the invention, whereas

DESCRIPTION OF THE SEVERAL EMBODIMENTS

Figure 1:
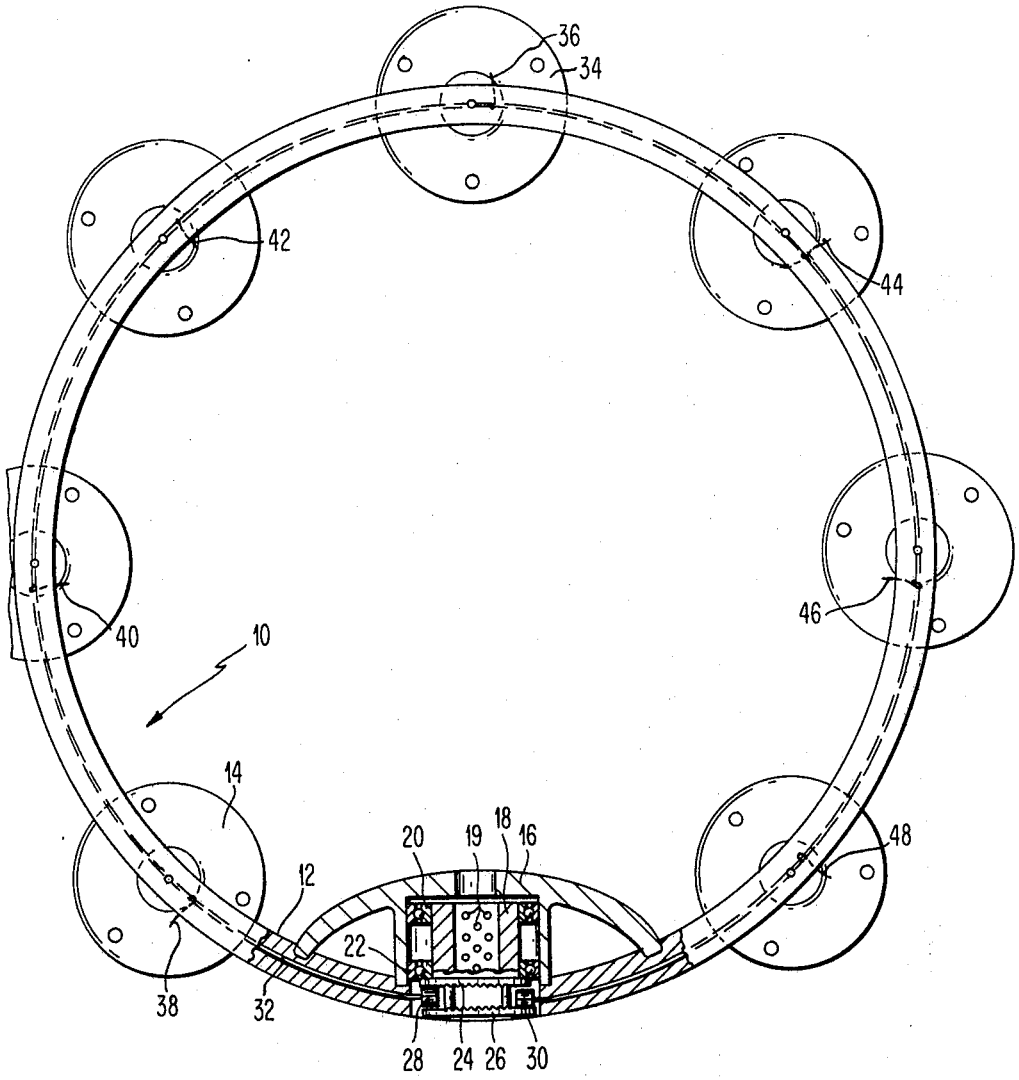
FIGS. 1 and 2 comprise a plan view partially in section of tambourines having mechanism for activating the cymbals within the tambourine frame by rotating the mechanism.

Referring to FIGS. 1–17 inclusive, the tambourine 10 according to the present invention is illustrated in FIG. 1 and comprises a frame 12 having cymbals 14, 34 inter alia, (other cymbals are illustrated, but not numbered) positioned in the frame in windows and mounted in such windows by means of pins. A hollow dome-like member 16 is secured to the frame 12 and has a tube 18 rotatably mounted therein by means of ball bearing and race sets 20 and 22. Tube 18 has nibs 19 mounted therein to provide air circulation around a finger inserted in the tube. The tube 18 may be constructed of a rigid material and lined with a soft pliable material having the nibs 19 extending from the material with which it is lined. Both the nibs 19 and the use of soft pliable material provide an extra degree of comfort for the entertainer using the tambourine as will become more apparent as the other features of the invention are described as well as from the description of the manner in which the tambourine may be used.

The tube 19 extends downwardly into a necked in portion that has ring gears 24 and 26 extending around it, the gear teeth of each being on the faces thereof and facing toward one another. The gear teeth on gear 24 engage gear 28 mounted on one end of flexible shaft 32 while the gear teeth on gear 26 engage the gear 30 mounted on the other end of shaft 32 to drive the shaft 32 when the tube 18 is rotated by placing the tube 18 on a crank handle (described hereinafter) or a finger and spinning the tambourine frame.

Figure 1B:
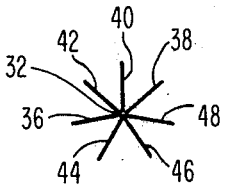
FIG. 1B is a front elevation of the embodiment shown in FIG. 1A.
Figure 1A:
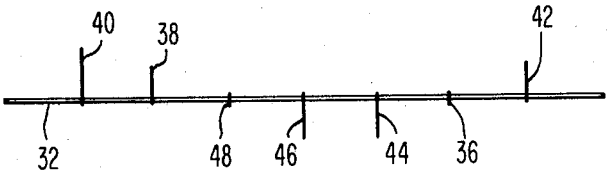

The flexible shaft 32 extends around the frame 12 and is mounted in openings within the frame. The shaft 32 has a plurality of striking members mounted on it i.e. members 38, 40, 42, 36, 44, 46 and 48. The striking members are arranged on the shaft 32 as illustrated in FIGS. 1A and 1B so that when the shaft 32 is rotated as described above, the cymbals adjacent the striking members will be struck in sequence and not in unison, although it is within the scope of this invention to arrange the striking members so that they will strike the cymbals in unison.

As the shaft 32 is rotated as described above, the striking members will move the cymbals into contact with one another and produce a sound characteristic of the tambourine. By placing the tambourine on a finger and spinning it, a theatrical effect may be created in which the entertainer can create both a visual and audible effect simultaneously which is not possible with the tambourines of the prior art for the reasons stated previously herein with respect to the Brick patent.

Figure 2:
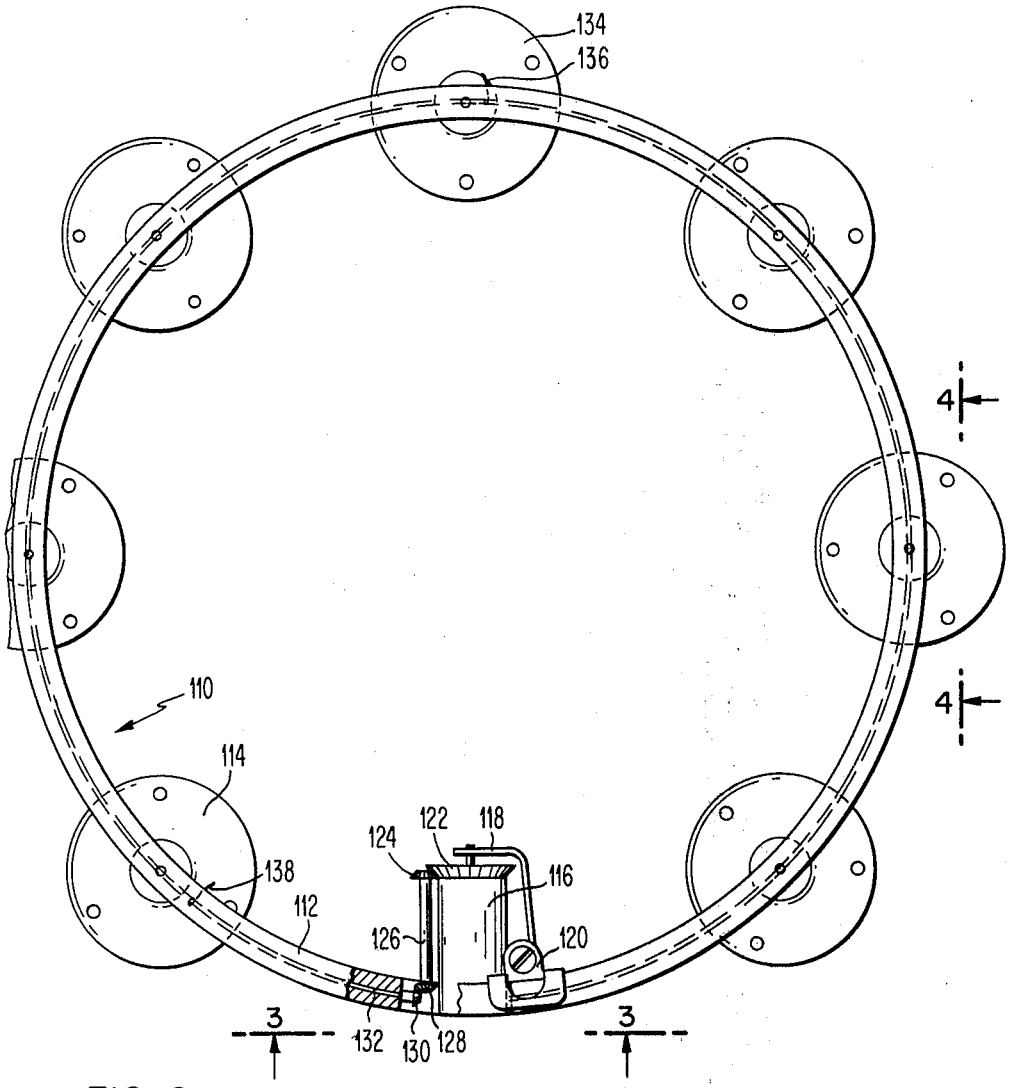

FIG. 2 comprises a frame 112 having cymbals 114 and 134 positioned in the frame in windows and mounted in such windows by means of pins. An open ended tube 116 is rotatably mounted on a bracket 118 secured to the frame 112 by means of a screw clamp 120. The open ended tube is aligned with an opening in the frame 112 and is adapted to rotate on its longitudinal axis which is substantially coincidental with the latitudinal axis of the frame 112. The top of the open ended tube 116 is provided with a beveled gear 122 which extends around the periphery of the tube 116. Beveled gears 124 and 128 are mounted on an axle, the axle being rotatably positioned within a cylinder 126 rigidly affixed to the frame 112 in a manner known in the art. A gear 128 is positioned to drive a gear 130 which in turn is affixed to a flexible shaft 132 which extends around the circumference of the frame 112 in an opening within the frame 112. The flexible shaft 32 or 132 may be constructed of any material, one material which has been found to be particularly effective comprises a steel wire. Striking members 136 and 138 are secured to the flexible shaft 132. Member 136 is positioned next adjacent an opening in cymbal 134 which is employed to mount the cymbal on a pin extending through the opening and secured in the frame. The opening in cymbal 134 or 34 is wider than the pin and the cymbal can rotate freely about the pin as well as move back and forth on the pin. This specific configuration is shown in greater detail in FIG. 4 and will be described subsequently. The cymbal 114 is similarly mounted in the frame by means of an opening which receives a pin secured to the frame. Member 138 which is used to strike cymbal 114 is positioned to strike the cymbal at the periphery thereof. By arranging the pins 136 and 138 as illustrated in FIG. 2, a rotating motion applied to the flexible shaft 132 by means of rotating the open ended tube 116 will cause the shaft to apply torque to the members 136 and 138. Member 136 however will prevent the shaft 132 from rotating until a sufficient amount of twist is put on the shaft and stored as potential energy at which time the member 136 will be suddenly released, the potential energy in the shaft being converted to kinetic energy and the members 136 and 138 will accelerate suddenly to strike the cymbals 134 and 114 respectively. With this arrangement of the flexible shaft 132 and the members 136 and 138, an arrangement is obtained whereby when the tambourine pin is rotated on its lateral axis in a smooth and even manner or at a constant rate, the members 136 and 138 will strike the cymbals 134 and 114 respectively in a rhythmic or intermittent manner. This effect is especially noticed when the tambourine is being rotated at a slow speed. The energy supplied to the hammers is built up before release thereby developing a loud tambourine sound without the need of vigorous or rapid spinning of the tambourine. The hammers such as hammers 136 and 138 may also be positioned to strike the cymbals peripherally and will function in this manner to produce a tambourine sound from the instrument 110.

Figure 3:
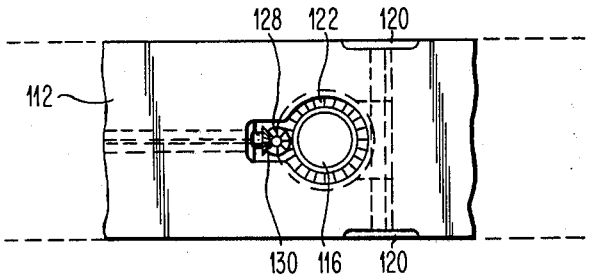
FIG. 3 comprises a side elvation in section taken along the line 3—3 of FIG. 2.
Figure 3A:
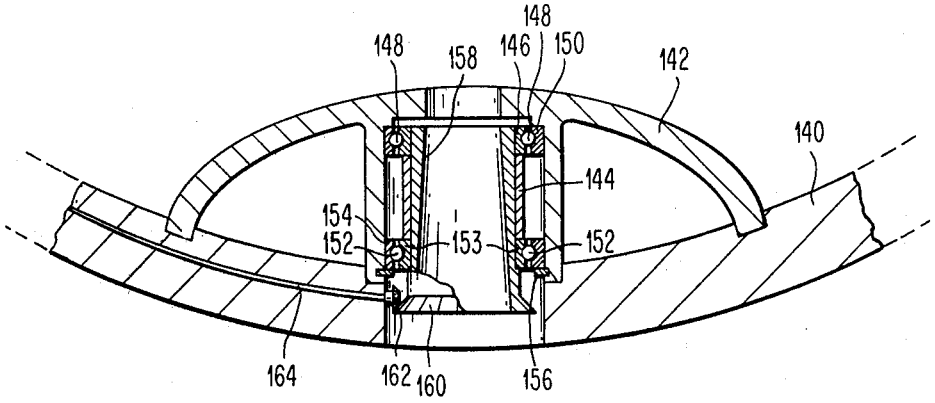
FIG. 3A comprises a partial side elevation in section illustrating a spinning member from which a tambourine may be rotated which is integral with the frame of the tambourine and which is operatively associated with a mechanism for individually striking the cymbals mounted in the tambourine frame.
Figure 3B:
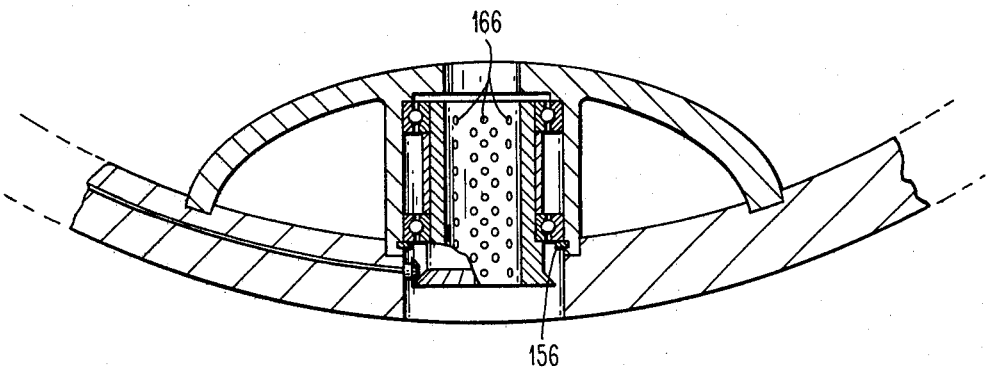
FIG. 3B also comprises a partial plan view of a spinning member as set forth in FIG. 3A with modifications thereof comprising nibs placed along the inner wall of the spinning member.

Referring to FIGS. 3A and 3B an alternate embodiment of the spinning mechanism is shown comprising a dome 142 secured to a frame 140 in which an open ended tube 144 is rotatably mounted by means of a bearing race 146 extending from and secured to the tube and a bearing race 150 abutting the dome 142, said bearing races rotating on ball bearing members 148. A lower bearing race 153 extends from and is secured to the tube and a lower bearing race 154 abuts the dome 142, the lower bearing races rotating on ball bearing members 152. A beveled gear 160 extends around the bottom of the tube 144 and engages a second beveled gear 162 secured to a flexible shaft 164. A soft, pliable hollow cone shaped insert 158 is also positioned inside of the tube 144 to provide a universal adapter member for snugly engaging a finger on which the tambourine may be rotated. The bearing races 150 and 154 are held in the dome 142 by means of a snap ring 156 which is known in the art.

Referring to FIG. 3B, a spinning mechanism substantially similar to the mechanism shown in FIG. 3A is illustrated, the insert in the open ended tube also being of a soft pliable material and having nibs 166 thereon so that when the tube is positioned on a finger, air may circulate around the finger and prevent discomfort to the person using the same while still providing a mechanism for snugly securing the tube onto the finger of the person manipulating the tambourine.

Figure 4:
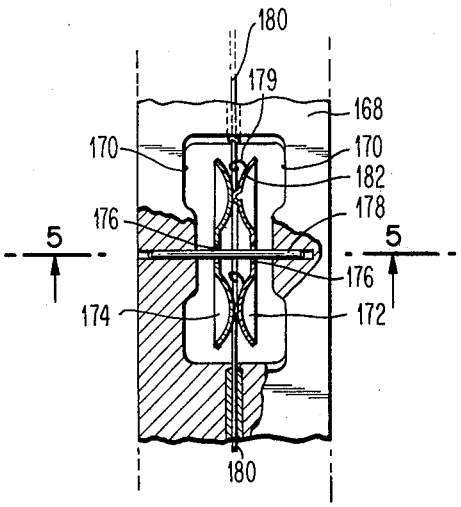
FIG. 4 comprises a partial side elevation in section of a window in the tambourine frame showing cymbal members mounted therein on a pin and hammer members mounted on a flexible shaft so that when the flexible shaft is rotated, the hammer members strike the cymbals.

FIG. 4 illustrates a bow-shaped window 170 inside of a tambourine frame 168, cymbals 172 and 174 being positioned in the window and mounted on a pin 178. The opening 176 in cymbal 172 is sufficiently large to allow the cymbal to rotate freely and move freely over the pin 178. The pin 178 is securely fastened in the frame 168 as illustrated. A flexible drive shaft 180 is illustrated in FIG. 4 on which a member 179 is mounted to peripherally strike the cymbal 172. The bow-shaped window provides a novel opening for mounting the cymbals and facilitates the production of sound when using the present invention.

Figure 5:
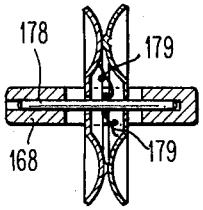
FIG. 5 comprises a sectional view of the embodiment illustrated in FIG. 4 taken along the line 5—5 of FIG. 4.
Figure 6:
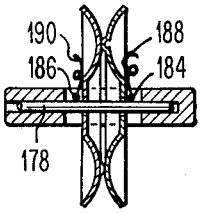
FIGS. 6 and 7 are side elevations in section through the windows of the tambourine frame showing different arrangements of hammers for striking the cymbals of the tambourine that are mounted in the window on a pin.
Figure 7:
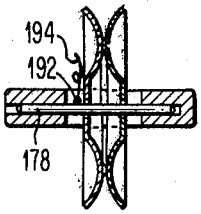

FIG. 5 as noted before comprises a side elevation in section taken along the line 4—4 of FIG. 4. FIGS. 6 and 7 are substantially the same as FIG. 5 with the exception that in FIG. 6 two flexible shafts 184 and 186 both driven with a mechanism similar to that illustrated in FIG. 1 are provided and which have members 188 and 190 on the outside thereof for striking the cymbals whereas in FIG. 7, a single flexible shaft 192 having a member 194 mounted thereon is illustrated in which the member 194 is positioned to strike the cymbal on the outside thereof.

Figure 8:
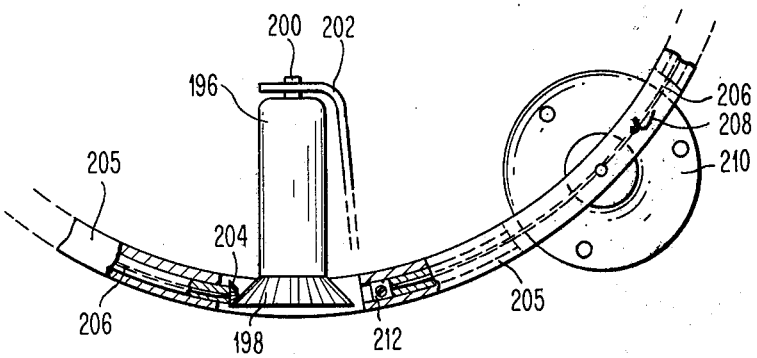
FIG. 8 comprises a partial plan view in section illustrating an alternate embodiment of the spinning member and arrangement of gears for driving the mechanism for striking the cymbals of the tambourine according to another embodiment of the invention.

FIG. 8 illustrates a tambourine having a frame 205 on which is mounted an open ended tube 196, the bottom of which has a beveled gear 198 extending around the outer periphery thereof. A spindle 200 extending from tube 96 is rotatably mounted in a bracket 202 rigidly secured to the frame 205. Gear 198 meshes with a beveled gear 204 secured to the end of a flexible shaft 206 used to drive members 208 positioned to strike the cymbal 210. The end of the flexible shaft 206 is rotatably mounted in a bearing 212.

Figure 8A:
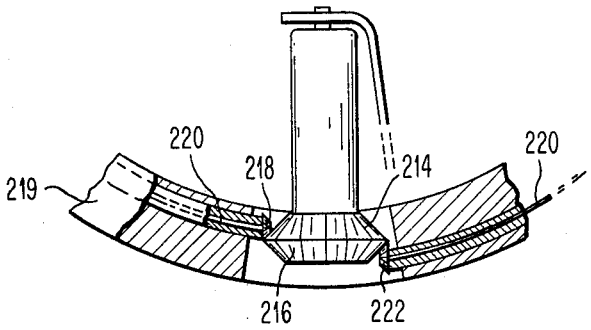
FIGS. 8A, 8B and 8C all comprise partial plan views in section showing the drive gear arrangement for driving both ends of a flexible shaft which is part of the mechanism for striking the cymbals of the tambourine of the invention.

FIG. 8A illustrates a tambourine frame 219 on which an open ended tube is mounted in the same manner as shown in FIG. 8A however the tube terminates in a double faced beveled gear extending around the outer periphery thereof having a beveled face 214 for driving gear 218 and a beveled face 216 for driving beveled gear 222. The gears 218 and 222 are secured to the ends of the flexible shaft 220 which extends completely around the tambourine in the manner described with reference to FIG. 2.

Figure 8B:
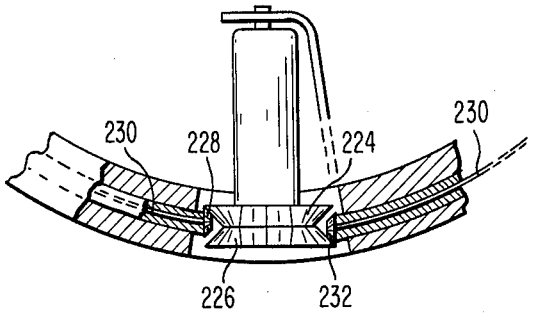

By employing this arrangement of gears the tambourine when rotated on the spindle drives both ends of the shaft 220. Similarly in FIG. 8B a beveled gear is illustrated having an upper gear face 224 and a lower gear face 226, gear 224 driving beveled gear 228 and gear 226 driving beveled gear 232. Both beveled gears 228 and 232 are fixed to the end of flexible shaft 230 for driving the shaft in a manner similar to that described with regard to FIG. 8A.

Figure 8C:
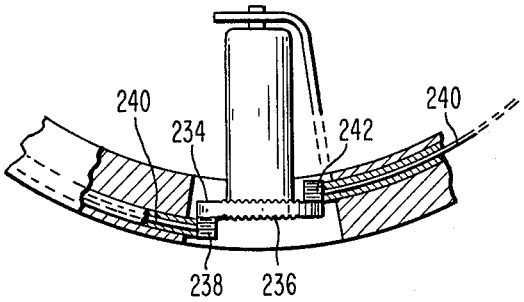

FIG. 8C is again substantially similar to the arrangement illustrated in FIG. 8A however the double faced gear employed comprises a flat gear having an upper face 234 for driving a gear 242 and a lower flat face 236 for driving gear 238, both gears 238 and 242 being secured to the ends of the flexible shaft 240.

Referring to FIGS. 9, 10, 10C, 11 and 12, a tambourine frame 244 is illustrated having a plurality of cymbals thereon. The cymbals such as cymbal 250 are activated by means of a flexible chain such as a high strength polyurethane micro chain having the teeth thereon arranged to engage gears such as gear 248 which rotates a pin having hammers thereon on which the cymbal 250 is mounted. The chain 246 is driven by means of an open ended tube mounted inside of dome 251, the securing of the open ended tube in a rotatable manner being illustrated and described previously with regard to FIGS. 3A and 3B. The tube has a beveled gear 252 secured to it and extending around the periphery thereof which in turn is used to drive a beveled gear and a flat gear 254 which engages the toothed surface of the micro chain 246. The frame 244 is arranged so that the dome 251 is mounted substantially at the geometric center of the frame. The striking mechanism employed in this embodiment is illustrated in greater detail in FIGS. 11 and 12 and comprises a pair of cymbals 250 and 276 having opposed dimples thereon 278 and 280. Cymbal 250 has pins 288 thereon which are engaged by a member 286 extending from pin 284 on which a gear 248 is mounted. The pin 284 rotates in bearings 290 and 292 which are secured in frame 244. The spring 275 is employed to keep the cymbals 250 and 276 slightly separated from one another when the tambourine is spun since centrifugal force generated in spinning the tambourine causes the cymbals to move toward one another and interfering with cymbals 250 striking cymbal 276 when the former is rotated which in turn prevents the cymbals from generating a sound.

Figure 9:
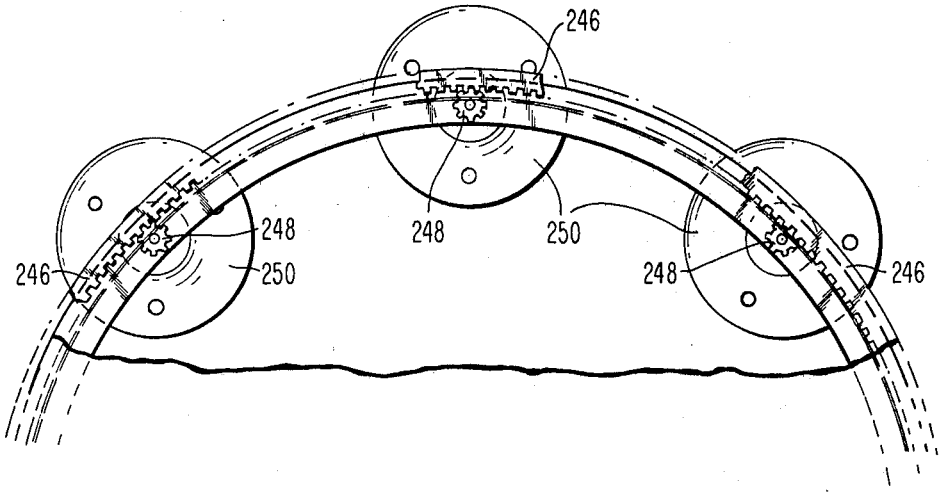
FIG. 9 comprises a partial plan view in section illustrating the gears for spinning the pins on which the cymbals of the tambourine are mounted and a flexible drive chain for rotating the gears and pins, hammers being provided on the pins for striking the cymbals as the gears are rotated.
Figure 10:
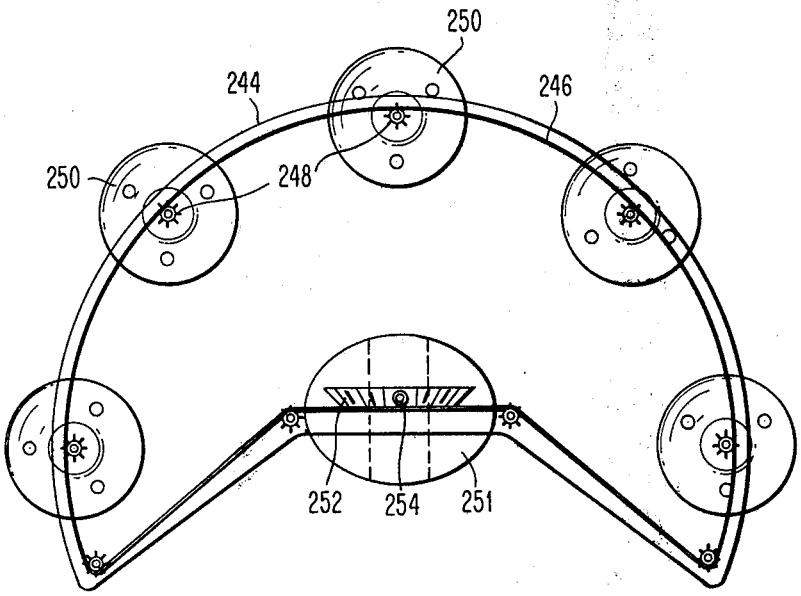
FIG. 10 comprises a plan view of a tambourine in which the spinning mechanism is placed at the geometric center of the frame on which the cymbals are mounted and in which the spinning mechanism engages a drive belt for rotating the gears and pins on which the cymbals are mounted.

When the tambourine of FIGS. 9 and 10 is rotated the belt 246 is turned which in turn rotates gear 248 and pin 284. With the rotation of pin 284, member 286 is rotated and engages the pins 288 which in turn causes the cymbal 250 to rotate. The dimples 278 and 280 which extend inwardly towards one another will then strike each other and cause the cymbals to ring or sound.

Figure 10A:
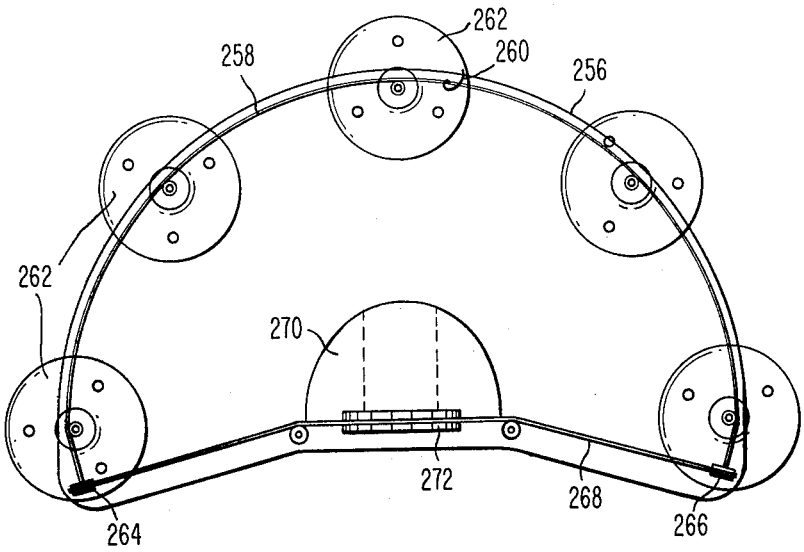
FIG. 10A comprises a plan view of a tambourine having a spinning mechanism positioned at substantially the geometric center of the tambourine and in which the cymbals are struck by hammers extending from a flexible shaft, the flexible shaft being driven by the spinning mechanism in combination with a belt.
Figure 10B:
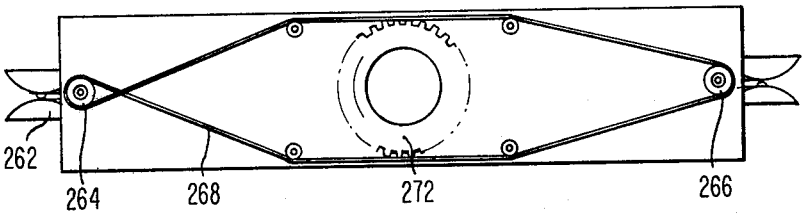
FIG. 10B comprises a side elevation of the apparatus in FIG. 10A showing the drive belt used for driving both ends of the flexible shaft of the striking mechanism employed in the embodiment illustrated in FIG. 10A and in which the drive belt is looped.
Figure 10C:
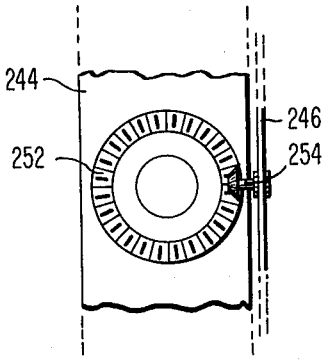
FIG. 10C comprises a partial side elevation illustrating the driving mechanism operatively associated with the spinning mechanism of the tambourine illustrated in FIG. 10.
Figure 11:
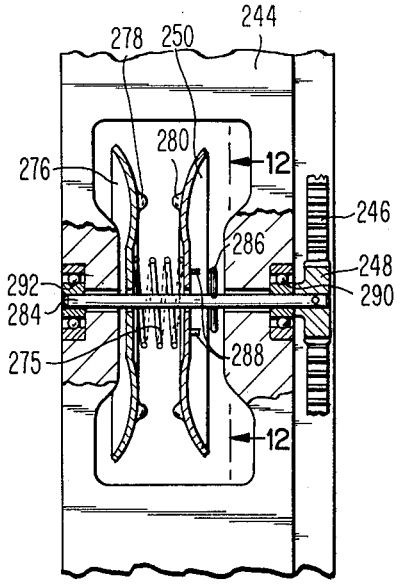
FIG. 11 comprises a partial plan view in section of a pair of dimpled opposed cymbals mounted in a window of the frame of the tambourine of the present invention, the cymbals being rotatably mounted on a pin having a hammer extending therefrom and being rotated by a gear, the pin also being mounted in the frame on ball bearings.
Figure 12:
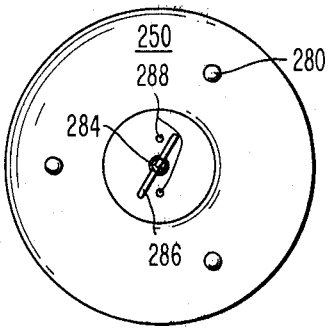
FIG. 12 comprises a plan view taken along the line 12—12 of FIG. 11.

In a further embodiment illustrated in FIGS. 10A and 10B, a frame 256 somewhat similar to and substantially equivalent in structure to the frame 244 in FIG. 10 is illustrated for positioning a spinning mechanism substantially at the geometric center of the frame. In this embodiment, however, a flexible shaft 258 is rotated to strike the cymbal 262 on the frame 256 by means of a hammer 260 extending from the shaft 258. A dome 270 is secured to the frame 256 in a manner similar to the dome fixed to the frame illustrated in FIGS. 3A and 3B and described herein, dome 270 having a rotating tube therein which is also mounted in a manner similar to the rotating tube mounted in the dome illustrated in FIGS. 3A and 3B described previously. A gear 272 extends around the outer periphery of the tube and drives a belt or micro-chain 268 positioned on pulleys along the bottom of the frame 256. The belt or micro chain drives a wheel or alternately a gear 264 and a wheel or gear 266 at the terminal ends of the flexible shaft 258 to cause the shaft to rotate. The drive belt 268 is looped as illustrated in FIG. 10B so that the ends of the flexible shaft 258 will be rotated in the proper direction.

Figure 13:
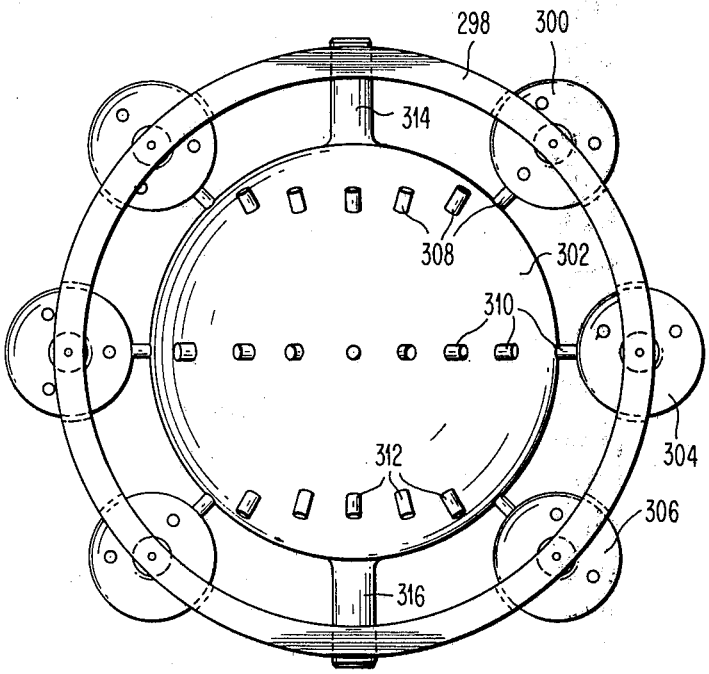
FIG. 13 comprises a plan view of a tambourine according to the present invention in which the striking mechanism comprises a sphere having a plurality of hammers extending from the edge thereof and arranged to strike the cymbals of the tambourine peripherially, the striking mechanism being mounted on a spinning member associated with the frame of the tambourine.
Figure 13A:
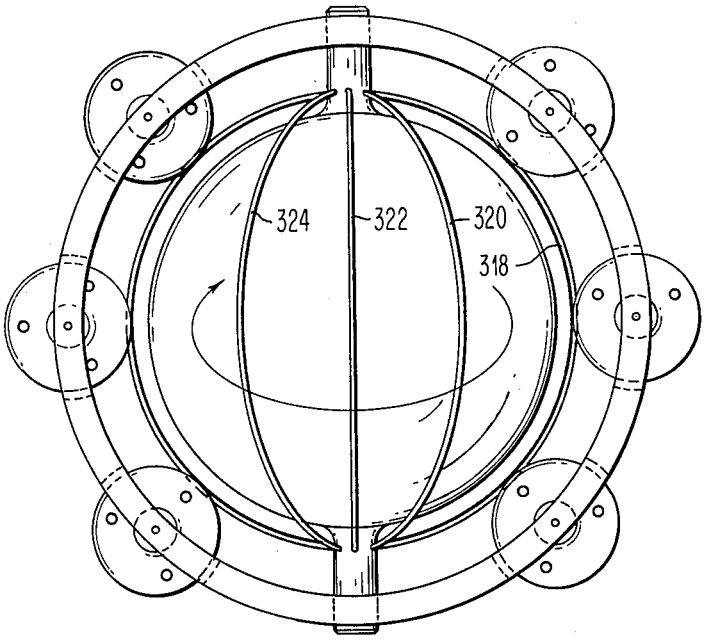
FIG. 13A comprises a plan view of the invention in which the striking member is similar to that of FIG. 13 however comprises a wire frame the edges of which are positioned to strike the cymbals of the tambourine peripherally.

FIG. 13 illustrates another embodiment of the present invention by which a spinning mechanism comprising a ball 302 is rotatably mounted on shafts 314 and 316 which turn in the frame 298 of the tambourine illustrated. The ball 302 has a plurality of striking members 308, 310 and 312 arranged to strike the cymbals 300, 304 and 306 on the periphery thereof. The tube 314 or 316 or both of them have openings therein for the insertion of a finger or a crank handle to spin the frame 298 and thereby cause the striking members on ball 302 to peripherally strike the cymbals mounted on the frame. The embodiment illustrates in FIG. 13A is equivalent to that shown in FIG. 13 however it uses a frame such as wires 318, 320, 322 and 324, adapted to strike the cymbals of the tambourine at the periphery of such cymbals.

Figure 14:
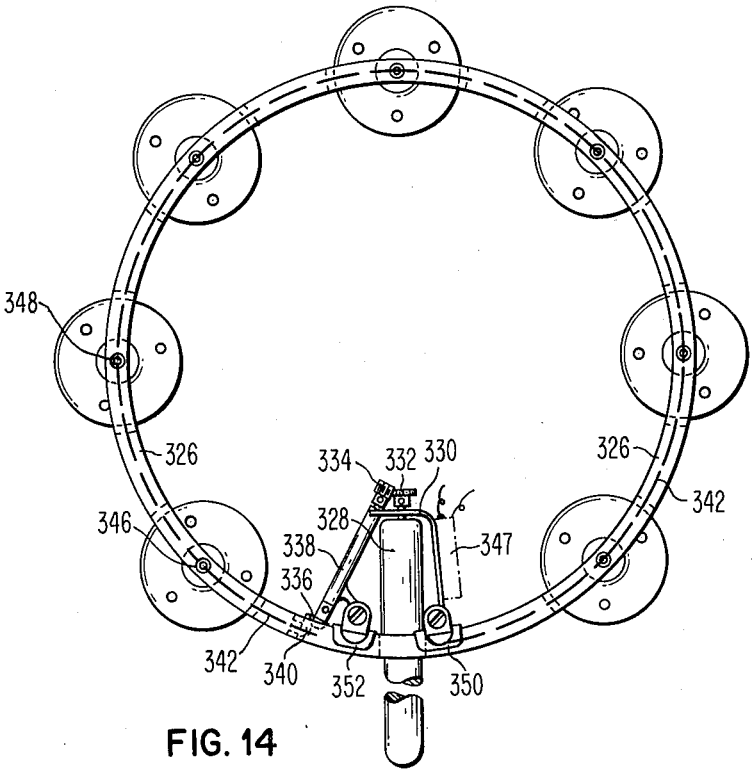
FIG. 14 comprises a plan view of a tombourine according to the present invention in which the cymbals are illuminated by lights positioned next adjacent the cymbals, the power for the lights being supplied by a battery mounted on the frame of the tambourine.

In a further embodiment, a tambourine is illustrated in FIG. 14 having an open ended tube 328 mounted above a circular opening in the frame 326 of the tambourine illustrated. Tube 328 is rotatably mounted on a bracket 330 secured to the frame 326 by means of a clamp 350. A drive gear 332 extends through the frame 326 engaging a gear 334 mounted on an axle which terminates in a second gear 336. The axle on which gears 334 and 336 are mounted is secured to the frame by means of a hollow cylinder 338 in which the axle rotates, cylinder 338 being secured to the frame 326 by means of clamp 352. Gear 336 engages a gear 340 secured to the end of a flexible shaft 342 having a single hammer or plurality of hammers arranged thereon in a manner similar to those illustrated in or described with reference to FIG. 2 for striking the various cymbals positioned around the frame 326. A single light or a plurality of lights such as lights 346 and 348 are positioned next adjacent the cymbals to illuminate the cymbals and are provided with a power by means of a battery 347, battery 347 being connected to the lights 346 and 348 in a manner known in the art.

Figure 15:
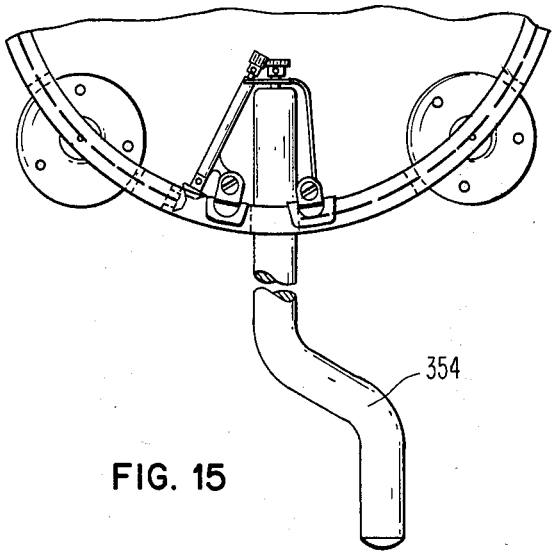
FIG. 15 comprises a partial plan view in section illustrating the rotating mechanism of a tambourine according to the present invention in which a crank handle is inserted into the spinning mechanism.
Figure 16:
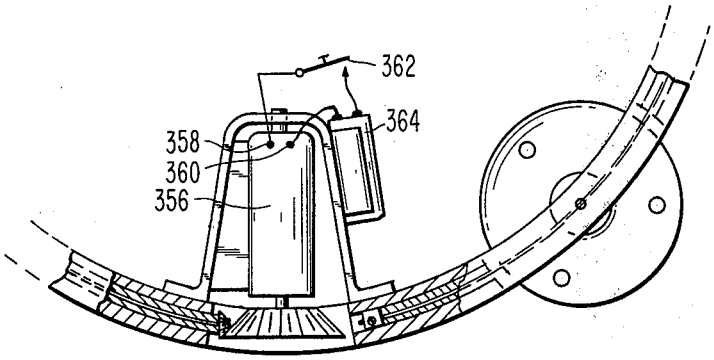
FIG. 16 comprises a partial plan view in section illustrating the spinning mechanism of a tambourine according to another embodiment of the invention in which the tambourine is spun by an electric motor connected to a battery powered source mounted on the frame of the tambourine.

In a further embodiment, a crank handle 354 may be inserted in the open ended tube as illustrated in FIG. 15 to assist in rotating the tube and operating the hammers on the flexible shaft therein.

In yet another embodiment, the tambourine may be rotated by means of an electric motor 356 mounted in the frame in a manner previously described with respect to the open ended tube, motor 356 having brush contacts 358 and 360 thereon for obtaining power from battery 364 through switch 362.

Figure 17:
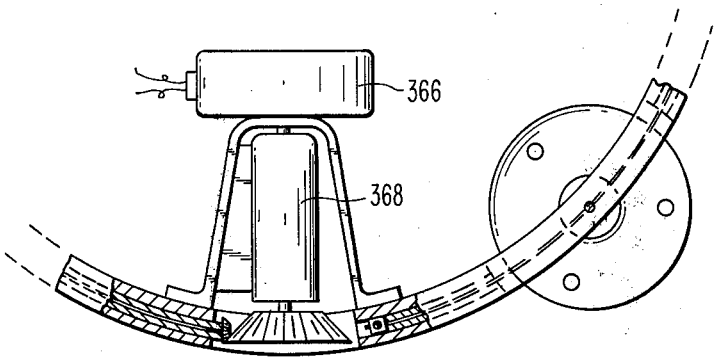
FIG. 17 comprises a partial plan view in section of a tambourine according to the present invention in which the spinning section is operatively associated with a dynamo for applying power to electric lights positioned next adjacent the cymbals for illuminating the cymbals.

In lieu of using a battery in the embodiment shown in FIG. 14 for lighting the lights 346 and 348, an open ended tube 368 as illustrated in FIG. 17 may be mounted in the tambourine frame in a manner previously described herein and a pin extended through the upper portion of the tube 368 for driving a dynamo 366 which in turn is connected to electric lights on the tambourine in a manner known in the art, the electric lights being positioned on the tambourine in a manner as illustrated by lights 346 and 348 in FIG. 14. The tube is rotated by placement on a finger, which in turn causes the dynamo to supply current to the lights.

Although the invention has been described by reference to some embodiments, it is not intended that the novel tambourine be limited thereby but that various modifications are intended to be included as falling within the broad spirit and scope of the foregoing disclosure, the following claims and the appended drawings.

What is claimed is:

1. A tambourine comprising (1) a frame having window means therein; (2) cymbal means adapted for generating sound and mounted on said frame in said window means; (3) activator means mounted on said frame operatively engaging said cymbal means for moving said cymbal means and to cause said cymbal means to generate sound; and (4) spinning means mounted on said frame for rotating said frame about its latitudinal axis, said spinning means being operatively associated with said activator means to cause said activator means to move said cymbal means;

wherein said activator means comprise flexible shaft means which can be rotated about its longitudinal axis when in a flexed configuration, said flexible shaft means being mounted on said frame and extending from said spinning means to said window means, striking means mounted on said shaft means is rotated on its longitudinal axis, said spinning means operatively engaging said flexible shaft means for rotating said flexible shaft means about its longitudinal axis.

2. The tambourine of claim 1 where said window means comprises a plurality of windows, each of said window means having cymbal means mounted therein, said cymbal means being mounted on pin means passing through said window means and secured in said frame for receiving said cymbal means in said frame, said cymbal means having an opening therein for receiving said pin means, said opening being wider than the diameter of said pin means, said striking means comprising a plurality of striking means, at least one of said striking means being positioned to strike one of said cymbal means next adjacent said opening in said cymbal means, the other of said striking means being positioned to strike said cymbal means at the edges thereof.

3. The tambourine of claim 1 where said spinning means comprises an open-ended tube rotatably mounted on said frame, the longitudinal axis of said tube being substantially coincidental with the lateral axis of said frame, said flexible shaft means being rotatably connected to said tube means by driving means on said tube for transmitting a rotating motion to said flexible shaft means and driven means on said flexible shaft means operatively associated with said driving means for applying a rotating motion to said flexible shaft means.

4. The tambourine of claim 3 where said tube is rotatably mounted in a dome secured to said frame.

5. The tambourine of claim 3 where said driving means comprises driving gear means extending around said tube and said driven means comprises driven gear means mounted to and extending around the longitudinal axis of said flexible shaft means.

6. The tambourine of claim 5 where said driving gear comprises a double-faced ring gear means, said flexible shaft means extends around said frame from one face of said ring gear means to the substantially diametric opposite face of said ring gear means, said driven gear means comprising a first gear mounted to and extending around the longitudinal axis of said flexible shaft means at one end thereof and engaging one face of said ring gear means and a second gear mounted to and extending around the longitudinal axis of said flexible shaft means at the other end thereof and engaging the other face of said ring gear means.

7. The tambourine of claim 3 or 5 further comprising a drive belt operatively connecting said driving means and said driven means.

8. The tambourine of claim 7 where said driving means comprises a driving gear means, said driven means comprises a driven gear means on each end of said flexible shaft means and said drive belt comprises a looped drive belt.

9. A tambourine comprising (1) a frame having window means therein; (2) cymbal means adapted for generating sound and mounted on said frame in said window means; (3) activator means mounted on said frame operatively engaging said cymbal means for moving said cymbal means and to cause said cymbal means to generate sound; and (4) spinning means mounted on said frame for rotating said frame about its latitudinal axis, said spinning means being operatively associated with said activator means to cause said activator means to move said cymbal means;

wherein said cymbal means are mounted on pin means passing through said window means and secured in said frame for securing said cymbal means in said frame, said cymbal means having an opening therein for receiving said pin means, said opening being wider than the diameter of said pin means, and wherein said activator means comprise means for rotating said pin means and means extending from said pin means for rotating said cymbal means when said pin means are rotated about their longitudinal axes, said spinning means operatively engaging said activator means for rotating said pin means about their longitudinal axes.

10. The tambourine of claim 9 where said spinning means comprise an open-ended tube rotatably mounted on said frame, the longitudinal axis of said tube being substantially coincidental with the lateral axis of said frame, said pin means being rotatably connected to said tube by driving means on said tube for transmitting a rotating motion to said pin means and driven means on said pin means for applying a rotating motion to said pin means.

11. The apparatus of claim 10 where said driving means comprise driving wheel means extending around said tube and said driven means comprise driven wheel means mounted to and extending around the longitudinal axis of said pin means, said driving wheel means and said driven wheel means being operatively connected by drive belt means.

12. The tambourine of claim 11 where said driving wheel means comprise a gear, said driven wheel means comprise a gear and said drive belt means comprise a chain drive.

13. The tambourine of claim 9 or 10 where said cymbal means comprise at least two cymbal means in each of said window means.

14. The tambourine of claims 9 or 10 where said cymbal means comprise at least two cymbal means in each of said window means, each of said cymbal means having dimples extending from its surface and arranged so that the dimples on opposed cynbal means extend towards one another.

15. A tambourine comprising (1) a frame having window means therein; (2) cymbal means adapted for generating sound and mounted on said frame in said window means; (3) activator means mounted on said frame operatively engaging said cymbal means for moving said cymbal means and to cause said cymbal means to generate sound; and (4) spinning means mounted on said frame for rotating said frame about its latitudinal axis, said spinning means being operatively associated with said activator means to cause said activator means to move said cymbal means;

wherein said activator means comprise rotating means mounted in said frame for rotating on its lateral axis within said frame, said lateral axis of said rotating means being substantially coincidental with the lateral axis of said frame and the longitudinal axis of said spinning means, said rotating means extending to and slightly beyond the periphery of said cymbal means for striking said cymbal means when said rotating means is rotated, said spinning means operatively engaging said rotating means for rotating said rotating means on its longitudinal axis.

16. The tambourine of claim 15 where said spinning means comprises an open ended tube rotatably mounted on said frame, the longitudinal axis of said tube being substantially coincidental with the lateral axis of said frame, said rotating means being rotatably connected to said tube.

17. The tambourine of claim 16 where said rotating means substantially comprises a disc member.

18. The tambourine of claim 16 where said rotating means substantially comprises a second frame.

19. The tambourine of claim 16 where said rotating means substantially comprises a three dimensional member having striking means extending from the surface thereof for striking said cymbal means, said striking means being in alignment with said cymbal means.

20. A tambourine comprising (1) a frame having window means therein; (2) cymbal means adapted for generating sound and mounted on said frame in said window means; (3) activator means mounted on said frame operatively engaging said cymbal means for moving said cymbal means and to cause said cymbal means to generate sound; (4) spinning means mounted on said frame for rotating said frame about its latitudinal axis, said spinning means being operatively associated with said activator means to cause said activator means to move said cymbal means; and (5) an electric motor operatively associated with said spinning means to rotate said spinning means.

21. A tambourine comprising (1) a frame having window means therein; (2) cymbal means adapted for generating sound and mounted on said frame in said window means; (3) activator means mounted on said frame operatively engaging said cymbal means for moving said cymbal means and to cause said cymbal means to generate sound; (4) spinning means mounted on said frame for rotating said frame about its latitudinal axis, said spinning means being operatively associated with said activator means to cause said activator means to move said cymbal means; (5) lights mounted on said tambourine to illuminate said cymbal means; and (6) a power source, connected to said lights, comprising a dynamo driven through said spinning means.

22. The tambourine recited in any one of claims 1, 9, 15, 20 or 21 where said cymbal means comprise at least two cymbals in each said window means.

23. The tambourine recited in any one of claims 1, 9, 15, 20 or 21 further comprising a crank handle extending from said spinning means.

24. The tambourine recited in any one of claims 1, 9, 15, 20 or 21, where said window means are bow-shaped.

25. The tambourine recited in any one of claims 1, 9, 15, 20 or 21, further comprising lights and a power source mounted on said tambourine to illuminate said cymbal means.

26. The tambourine of claim 25 where said power source comprises a battery mounted on said tambourine.

* * * * *